US009711905B2

(12) United States Patent
Lappoehn

(10) Patent No.: US 9,711,905 B2
(45) Date of Patent: Jul. 18, 2017

(54) REVERSE POLARITY PROTECTION

(71) Applicant: ERNI Production GmbH & Co. KG, Adelberg (DE)

(72) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 15/125,617

(22) PCT Filed: Mar. 9, 2015

(86) PCT No.: PCT/DE2015/100093

§ 371 (c)(1),
(2) Date: Sep. 13, 2016

(87) PCT Pub. No.: WO2015/135531

PCT Pub. Date: Sep. 17, 2015

(65) Prior Publication Data

US 2017/0005437 A1 Jan. 5, 2017

(30) Foreign Application Priority Data

Mar. 14, 2014 (DE) ..... 10 2014 003 477

(51) Int. Cl.
*H01R 13/64* (2006.01)
*H01R 13/645* (2006.01)

(52) U.S. Cl.
CPC ..... *H01R 13/6456* (2013.01); *H01R 13/64* (2013.01)

(58) Field of Classification Search
CPC ..... H01R 13/64; H01R 13/6456; H01R 12/7005; H01R 13/6453
(Continued)

(56) References Cited

U.S. PATENT DOCUMENTS 4,376,565 A 3/1983 Bird et al.
4,558,916 A 12/1985 Hehl
(Continued)

FOREIGN PATENT DOCUMENTS

DE 12 02 856 A 10/1965
DE 33 15 688 A1 3/1984
(Continued)

OTHER PUBLICATIONS

International Search Report of PCT/DE2015/100093, mailed May 27, 2015.

(Continued)

*Primary Examiner* — Xuong Chung Trans
(74) *Attorney, Agent, or Firm* — Collard & Roe, P.C.

(57) ABSTRACT

Reverse polarity protection for plug-in connectors comprising two intermateable plug-in connector parts (100, 200), wherein the one plug-in connector part (100) comprises a first coding element and the other plug-in connector part (200) comprises a second coding element and wherein the two coding elements are matched to each other in such a manner that when the plug-in connector parts (100, 200) are arranged correctly they make a plug-in connection possible and that when the plug-in connector parts (100, 200) are not arranged correctly prevents a plug-in connection, characterized in that the one coding element is a groove (110) extending in the mating direction and having a trapezoid-shaped cross-section, and that the other coding element is a coding rib (210) that is extending in the mating direction and that is formed in a U-shaped manner with elastically bendable walls (212, 213) that are arranged in a U-shaped configuration.

7 Claims, 3 Drawing Sheets

(58) Field of Classification Search
USPC ..... 439/680, 681
See application file for complete search history.

(56) References Cited

U.S. PATENT DOCUMENTS

| | | | | |
|---|---|---|---|---|
| 5,772,475 | A | 6/1998 | Lindeberg et al. | |
| 6,875,027 | B2 * | 4/2005 | Ye | H01R 13/627 439/345 |
| 9,033,719 | B2 | 5/2015 | Shimizu et al. | |
| 9,335,205 | B2 * | 5/2016 | Luhr | H05K 5/0056 |
| 9,478,895 | B2 * | 10/2016 | Lappoehn | H01R 13/6272 |
| 2004/0023564 | A1 | 2/2004 | Yamamoto et al. | |
| 2009/0325416 | A1 | 12/2009 | Shindo et al. | |

FOREIGN PATENT DOCUMENTS

| | | | |
|---|---|---|---|
| DE | 14 25 466 | A1 | 1/1996 |
| DE | 11 2012 002 781 | T5 | 3/2014 |
| JP | H10-223299 | A | 8/1998 |
| WO | 2013/005629 | A1 | 1/2013 |

OTHER PUBLICATIONS

German Office Action in DE 10 2014 003 477.1, dated Dec. 18, 2014, with English translation of relevant parts.

* cited by examiner

REVERSE POLARITY PROTECTION

CROSS REFERENCE TO RELATED APPLICATIONS

This application is the National Stage of PCT/DE2015/100093 filed on Mar. 9, 2015, which claims priority under 35 U.S.C. §119 of German Application No, 10 2014 003 477.1 filed on Mar. 14, 2014, the disclosure of which is incorporated by reference. The international application under PCT article 21(2) was not published in English.

The invention relates to a reverse polarity protection for plug-in connectors comprising two intermateable plug-in connector parts.

STATE OF THE ART

In order to avoid reverse polarity due to mismating of two plug-in connector parts, what is very often done today is to provide a reverse polarity protection, wherein one plug-in connector part has a first coding element and the other plug-in connector part has a second coding element. The coding elements are arranged at the two plug-in connector parts in such a way that a plug-in connection is possible only in one desired position of the plug-in connector parts. At the same time, any incorrect arrangement of one plug-in connector part with regard to the other, for example a rotation by 180 degrees that would lead to a reverse polarity, is effectively prevented by such a reverse polarity protection.

Such plug-in connectors are also used in rough environments, for example in automobiles or aircrafts, such as helicopters. In such application cases, considerable stress through shaking and vibrations can occur, which may lead to an unintentional separation of the two plug-in connector parts and thus to contact interruptions. For this reason, such plug-in connectors also comprise locking elements for preventing any unintentional disengagement. But even with these locking elements which prevent an unintentional separation of the two plug-in connector parts it cannot be excluded that, as considerable stress through shaking and vibrations occurs, the contact elements of the plug-in connector parts rub against each other and the contact elements of the plug-in connector parts are damaged due to this continuous friction with corresponding vibration frequencies, which may even result in an irreversible interruption of the electric contact.

DISCLOSURE OF THE INVENTION

Advantages of the Invention

The reverse polarity protection for plug-in connectors according to the invention having the features described herein does not only facilitate a reverse polarity protection in a very advantageous and effective manner, but at the same time also provides for a fixation of the two plug-in connector parts to each other, namely in such a manner that even when it comes to considerable loads through shaking and vibrations, any movement of the two plug-in connector parts relative to each other is practically excluded. Here, the great advantage lies in the fact that no additional devices have to be provided at the plug-in connector parts in order to prevent such a relative movement of the plug-in connector parts relative to each other when considerable shaking and vibration loads occur. Rather, through the design of the one coding element as a groove extending in the mating direction and having a trapezoid-shaped cross-section, and the other coding element as a U-shaped coding rib extending in the mating direction and having elastically bendable walls, arranged in a U-shape, it becomes possible to create a defined gripping force of the coding rib inside the coding groove. Thus, in the solution according to the invention, the reverse polarity protection represents a device which simultaneously prevents a relative movement of the two plug-in connector parts relative to each other in an effective manner, even when it comes to considerable load levels caused by shaking and vibrations.

This is realized by the vertically rising O-shaped walls, which in short will be referred to as U-walls below, of the U-shaped coding rib, which thanks to the trapezoid-shaped design of the groove are elastically deformed as they are pressed inwards due to the oblique arrangement of the walls, thus exerting a force on the walls that are arranged in a trapezoid-shape. In this manner, a fixation of the two plug-in connector parts inside each other is facilitated in their intermated state. Due to the elastic design of the U-walls, it is also possible to unplug the two plug-in connector parts by exerting a settable pull-out force. After disengagement of the two plug-in connector parts, the U-walls are bent back due to their elasticity. In a new plug-in process, they are again bent inwards owing to the oblique positioning of the walls that are arranged in a trapezoid shape, exerting a force which is acting in the direction of the trapezoid-shaped walls due to their elasticity, which causes clamping of the coding rib inside the trapezoid-shaped groove.

By means of the further measures described herein, advantageous further developments of the reverse polarity protection are possible. In principle, in this manner the force with which the U-walls act on the trapezoid-shaped, obliquely positioned walls of the groove can be defined based on the length of the U-walls in the mating direction. At a given thickness, long U-walls, practically extending all along the groove, allow for a greater force than short U-walls. According to a particularly advantageous embodiment it is provided that the force is defined based on the thickness of the U-walls and thus that the thickness of the U-walls is adjusted to match a settable pull-out force of the one plug-in connector part as it is pulled out from the other. In this way, the U-walls can be formed along the entire length in the mating direction, which significantly contributes to the stability of the U-walls, since they can also be connected outside of the groove, e.g. to a housing part of the plug-in connector part, particularly on that one of their sides that is facing away from the mating face, which would not foe possible if the U-walls were designed to be shorter, since they always have to begin on the mating face of the plug-in connector part in order for the reverse polarity protection to be realized, and thus cannot extend along the entire length of the groove.

In a particularly advantageous and preferred embodiment, it is provided that the U-shaped coding rib, on its front end which is located at the side of the mating face, has an area that is formed in a trapezoid shape, namely in such a manner that its external trapezoid shape is adjusted to the trapezoid-shaped groove. This front trapezoid-shaped area, preferably formed as a trapezoid-shaped web, is preferably connected to the U-shaped walls of the U-shaped coding rib. Thus, the walls that are arranged in a U-shaped manner are connected to the trapezoid-shaped web at the front end located at the side of the mating face, while they can be connected to a housing part of the plug-in connector part at their back end which is facing away from the mating face. In this way, with the front trapezoid-shaped area of the coding rib creating higher resisting forces in case of an incorrect arrangement of the plug-in connector parts relative to each other, it is not only the reverse polarity protection that is rendered more resilient. Furthermore also the stability and resilience against any damage to the U-walls is enhanced by the walls being connected to the housing part at two sides, namely to the trapezoid-shaped web that is part of a plug-in connector housing at the front end that is located at the side of the mating face, and to the respective housing part, such as e.g. a housing wall of the plug-in connector housing, at the rear end that is facing away from the web side.

At that, it is provided in a particularly preferred embodiment that slide areas, which are respectively extending obliquely in the mating direction, are arranged between the trapezoid-shaped web and the walls that are arranged in a U-shaped manner. By means of these slide areas it is facilitated that the coding rib can slide into the coding groove when the two plug-in connector parts are correctly intermated. During the plug-in process, they also support the inward bending of the walls that are arranged in a U-shaped manner inside the trapezoid-shaped groove.

Here, the groove with a trapezoid-shaped cross-section is arranged in an advantageous manner inside a plug-in connector housing of the one plug-in connector part, and the coding rib is preferably arranged at the plug-in connector housing of the other plug-in connector part. The coding rib is preferably formed as an integral part of the plug-in connector housing.

What is more, it is provided in an advantageous manner, [that] the U-shaped walls taper off towards the housing wall at their ends which are facing away from the mating face and at which they are connected to a housing wall. This facilitates that the two plug-in connector parts slid into each other completely.

SHORT DESCRIPTION OF THE DRAWINGS

Embodiments, of the invention are shown in the drawings and described in more detail in the following description.

EMBODIMENTS OF THE INVENTION

Figure 1:
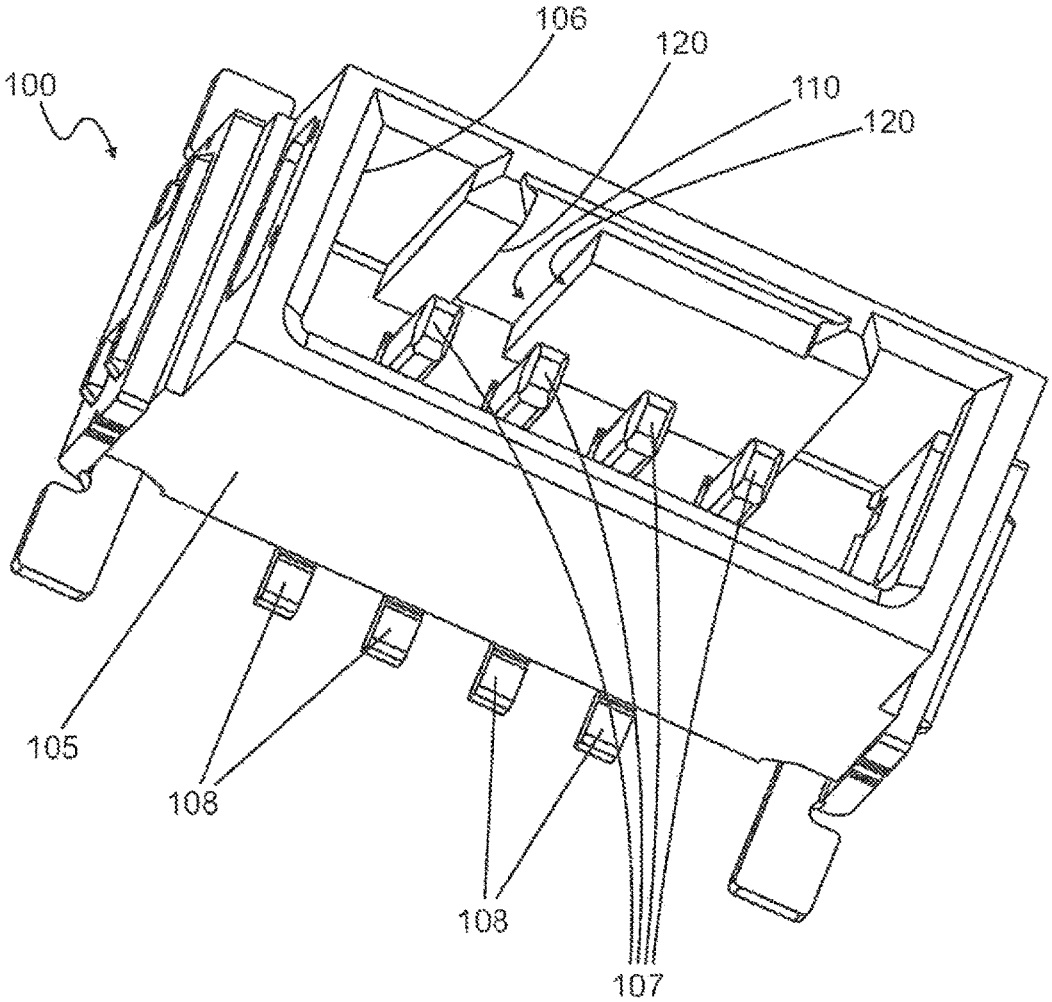
FIG. 1 shows an isometric, partial cutaway illustration of a plug-in connector part comprising a coding element that is formed as a coding groove having a trapezoid-shaped cross-section.

A plug-in connector that is shown in the Figures has two plug-in connector parts that can be intermated. A first plug-in connector part 100 is formed e.g. as a male multipole plug-in connector with a housing 105 in which a plug opening 106 is provided, inside of which in turn blade contacts 107 are arranged. This plug-in connector part 100 is arranged e.g. on a circuit board (not shown), with corresponding SMD contact elements 108 being provided for this purpose.

Figure 2:
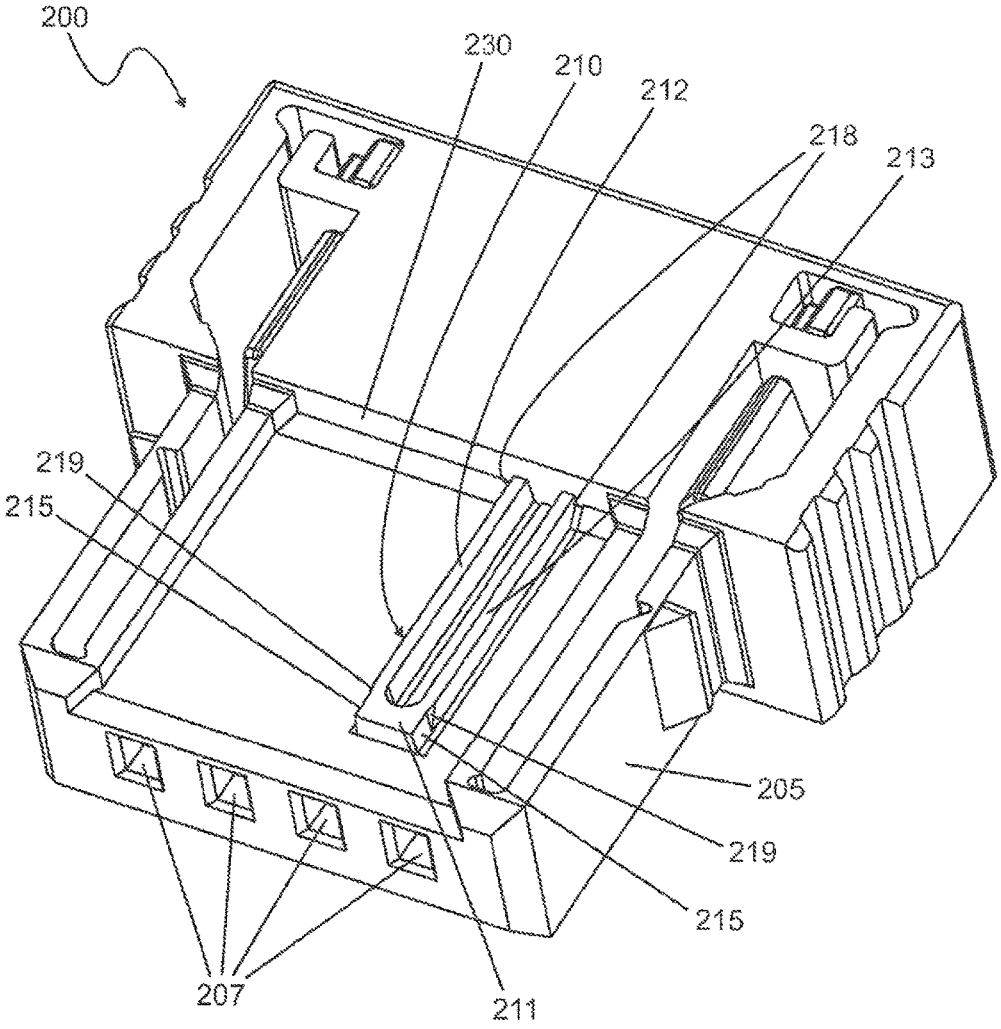
FIG. 2 shows an isometric, partial cutaway illustration of a second plug-in connector part that is corresponding to the plug-in connector part shown in FIG. 1 and having a coding element in the form of a coding rib which is formed in a U-shaped manner.

Matching this plug-in connector part 100, a plug-in connector part 200 is shown in FIG. 2. It is formed as a female multipoint connector. It has a housing 205 inside which openings 207 are arranged, inside of which in turn per se known spring elements, that are not visible in FIG. 2, are arranged.

The plug-in connector part 100 shown in FIG. 1 has a first coding element 110 in the form of a groove with trapezoid-shaped walls 120, the plug-in connector part shown in FIG. 2 has a second coding element 210 which is formed as a coding rib that, in its front area, terminates in a web 211 which comprises trapezoid-shaped side walls 215. This trapezoid-shaped web 211 has dimensions that are adjusted to the trapezoid-shaped groove 110 in such a manner, that sliding of the second coding element 210 into the first coding element 110 is possible when the plug-in connector parts are correctly arranged relative to each other. In contrast, when the plug-in connector parts 100, 200 are not correctly arranged, a plug-in connection is not possible, since the coding rib 210 hits against the housing wall of the housing 100, for example, so that a plug-in connection is prevented. Hereby, a reverse polarity protection is realized by means of the groove 110 and the coding rib 210. At the same time, this reverse polarity protection fulfills another very important function. That is to say, it serves for fixating the two plug-in connector parts 100, 200 to each other, namely in such a manner that even as the plug-in connection is exposed to high load levels through vibrations and shaking, any movement of the plug-in connector parts 100, 200 relative to each other is excluded. Thus, any rubbing of the contact elements, that is, of the blade contacts 107 and the spring contacts, against each other caused by vibrations as well as the occurrence of any damage to the contacts which may even lead to contact interruption is prevented in a very effective manner.

In order to achieve this clamping effect, the coding rib 210, in its back area which is facing away from the mating face, is formed in a U-shaped manner comprising walls that are arranged in a U-configuration and that will for short be referred to as U-walls 212, 213 below. At the mating face, these U-walls 212, 213 end in the trapezoid-shaped web 211 and are connected to the same. At the side that is facing away from the mating face, they end in a housing wall 230, wherein they are connected to the housing wall 230 at that position. The transition from the trapezoid-shaped web 211 with its obliquely positioned walls 215 into the vertically positioned U-walls 212, 213 is achieved through obliquely extending slide areas 219 by which sliding of the U-walls 212, 213 into the trapezoid-shaped groove 110 with its obliquely positioned walls 120 is facilitated. The U-walls 212, 213 which are connected to the housing wall 230 at their side that is facing away from the mating face, have taperings 218 on that side. These taperings 218 facilitate a complete insertion of the two plug-in connector parts 100, 200 into each other. Because of the clamping effect of the U-walls, this would not be readily possible without such a tapering 213. This clamping effect is explained in more detail below in connection to FIGS. 3 and 4.

Figure 4A:
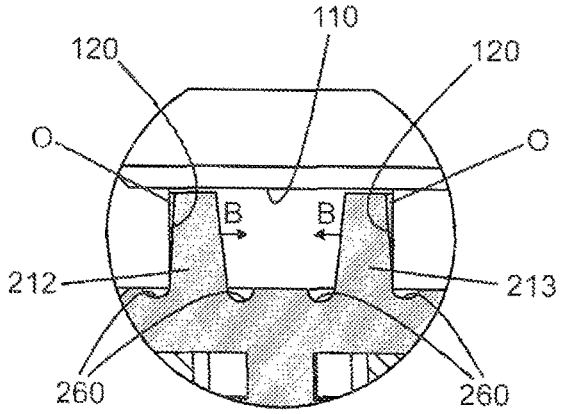
FIG. 3 shows a sectional view of the two intermated plug-in connector parts and FIG. 4 shows an enlargement of a section that is identified by IV in FIG. 3.
Figure 3:
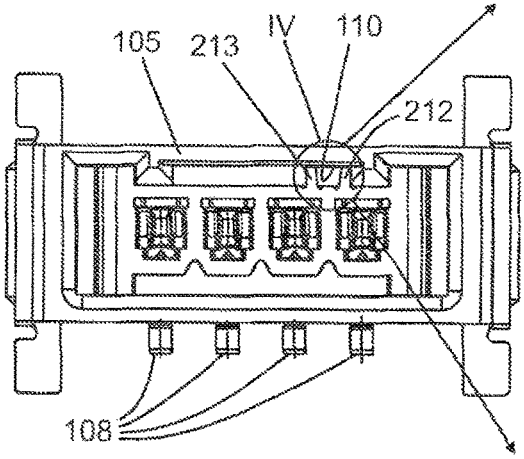
Figure 4B:
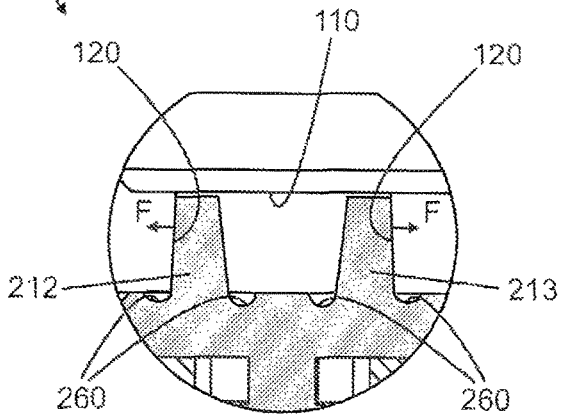

FIG. 3 is a sectional view of the two intermated plug-in connector parts 100, 200. In the upper area, the U-shaped coding rib 210 including its U-walls 212, 213 is shown, which is arranged inside the groove 110 with the trapezoid-shaped walls 120. In FIG. 4*a*, 4*b* the plug-in process is schematically shown. FIG. 4*a* shows the groove 110 with the trapezoid-shaped walls 120. The U-walls 212, 213 of the U-shaped coding rib 210 are positioned vertically, so that an overlap O is created. This overlap O is present before the plug-in process. During the plug-in process, the U-walls 212, 213 of the coding rib 210 are elastically bent inward in the direction of the arrows that are identified by B, thus leaning against the trapezoid-shaped, i.e. obliquely positioned, walls 120 of the first coding element 110 after the plug-in connection has been made. That state is shown in FIG. 4*b*. Due to their elastic deformability, the two walls 212, 213 exert a force F in the direction of the obliquely positioned trapezoid-shaped walls 120 by which a fixation of the two plug-in connector parts 100, 200 against each other is made possible. Principally, this force F can be set, as it were, through the length of the U-walls 212, 213 in mating direction, or better still through the thickness of the U-walls 212, 213. It can either be calculated or determined based on respective experimental tests.

In order to enhance the bending properties of the walls 212, 213 as well as to render the plug-in connection of the two housing parts 100, 200 easier, it can be provided that the walls 212, 213 comprise recesses 260 at their base that can be formed in the shape of a semicircle, for example (FIG. 4*a, b*).

The invention claimed is:

1. Reverse polarity protection for plug-in connectors comprising two intermateable plug-in connector parts, wherein the one plug-in connector part comprises a first coding element and the other plug-in connector part comprises a second coding element, wherein the two coding elements are matched to each other in such a manner that when the plug-in connector parts are arranged correctly they make a plug-in connection possible, and such that when the plug-in connector parts are not arranged correctly they prevent a plug-in connection, wherein the one coding element is a groove extending in the mating direction and having a trapezoid-shaped cross-section, wherein the other coding element is a coding rib that is extending in the mating direction and that is formed in a U-shaped manner with elastically bendable walls that are arranged in a U-shaped configuration, and wherein the coding rib ends in a trapezoid-shaped web that is located at the side of the mating surface and that has a cross-section that is adjusted to the trapezoid-shaped cross-section of the groove.

2. Reverse polarity protection according to claim 1, wherein between the trapezoid-shaped web and the walls that are arranged in the U-shaped configuration obliquely extending sliding areas are respectively arranged in the mating direction.

3. Reverse polarity protection according to claim 1, wherein the thickness of the walls that are arranged in a U-shaped manner is adjusted to a settable pull-out force that occurs as one plug-in connector part is pulled out of the other one.

4. Reverse polarity protection according to claim 1, wherein the groove with the trapezoid-shaped cross-section is arranged in a first plug-in connector housing of the plug-in connector part, and wherein the coding rib is arranged at a second plug-in connector housing of the other plug-in connector part.

5. Reverse polarity protection according to claim 4, wherein the walls that are arranged in a U-shaped manner are connected to a housing wall of the plug-in connector housing of the second plug-in connector part.

6. Reverse polarity protection according to claim 5, wherein the walls of the coding rib that are arranged in a U-shaped manner taper off outwards towards the housing wall.

7. Reverse polarity protection according to claim 1, wherein the walls that are arranged in a U-shaped manner respectively have recesses at their base.

* * * * *